United States Patent [19]

Brill

[11] Patent Number: 4,671,171

[45] Date of Patent: Jun. 9, 1987

[54] AERODYNAMICALLY OPERATED RAIN CAP

[76] Inventor: Robert Brill, P.O. Box 5147, Golden, Colo. 80401

[21] Appl. No.: 815,253

[22] Filed: Dec. 31, 1985

[51] Int. Cl.[4] ..... F23L 17/02

[52] U.S. Cl. ..... 98/59; 98/73

[58] Field of Search ..... 98/20, 59, 73, 122

[56] References Cited

U.S. PATENT DOCUMENTS

| | | | |
|---|---|---|---|
| 2,396,876 | 3/1946 | Olsen | 98/73 |
| 3,446,010 | 5/1969 | Hopkins | 98/59 X |
| 3,964,376 | 6/1976 | Janke | 98/59 |
| 4,059,045 | 11/1977 | McClain | 98/122 |
| 4,205,706 | 6/1980 | Jasensky | 98/59 X |
| 4,495,859 | 1/1985 | Janke | 98/59 |

FOREIGN PATENT DOCUMENTS

| | | | |
|---|---|---|---|
| 953741 | 12/1956 | Fed. Rep. of Germany | 98/73 |
| 878084 | 1/1943 | France | 98/73 |
| 3020 | of 1896 | United Kingdom | 98/73 |

*Primary Examiner*—Harold Joyce

*Attorney, Agent, or Firm*—Gregg I. Anderson

[57] ABSTRACT

A rain cap or protective cover device for an exhaust stack of an internal combustion engine is disclosed that is movable between a standby protective position and an operating position. In the standby position a pair of rearwardly extending arms cause a fairing of the rain cap to cover an outlet of an exhaust stack to which the rain cap is pivotally connected. In the operating position, winglets connected to the arm interact with air flow past the stack to raise the arms and move the fairing to a conformable position about the exhaust stack. The fairing is shaped to aerodynamically interact with the air flow to establish a low pressure area at the outlet of the exhaust stack.

5 Claims, 6 Drawing Figures

AERODYNAMICALLY OPERATED RAIN CAP

BACKGROUND OF THE INVENTION

1. Field of the Invention

This invention relates to protective covers or rain caps used to cover an outlet of an exhaust stack of an internal combustion engine when the engine is idling or stopped. The rain cap opens the outlet when exhaust pressure increases and the vehicle is moving. More particularly, the invention relates to an improved rain cap that uses aerodynamic forces arising from air flow past the rain cap to move the cap and open the outlet. A fuel-efficient aerodynamic profile is presented to the air flow by the rain cap when the outlet is opened.

2. Brief Description of the Prior Art

Rain caps for diesel and gasoline internal combustion engines have been known for use on construction equipment, farm tractors and over-the-road tractor trucks. All of these vehicles use upstanding exhaust pipes or stacks projecting vertically from the manifolds of the engine. Rain or weather caps protect the internal parts of the internal combustion engines from moisture. Absent such a cap, the equipment, which often sits for extended periods of time, could accumulate moisture from rain and snow entering the engine from the exhaust stack. An open exhaust valve is all that is necessary for the engine to fill with water and develop rust or a hydrostatic lock, often resulting in a bent connecting rod when the engine is started.

More recently, over-the-road diesel tractor trucks have a water trap formed by extending the exhaust below the manifold, which makes it extremely difficult for water to enter the engine. The main purpose of rain or weather caps has therefore been to keep the exhaust pipe from accumulating moisture, rather than the engine. The interior of a modern diesel truck exhaust pipe is coated with unburned carbon. Upon starting of the engine, any loose carbon is ejected from the pipe and deposited on the truck cab and any trailer connected to the truck. Preventing moisture from entering the stack decreases the amount of carbon loosened by moisture and lowers the maintenance cost associated with cleaning the trucks.

Current rain caps, exemplified by the prior art patent to R. McClain (U.S. Pat. No. 4,059,045), are pivotally mounted about an axis that does not pass through the exhaust pipe. A clamp is mounted on the end of the exhaust pipe and pivotally mounts the cap. The two major disadvantages to such a cap are the excessive back pressure the engine must overcome, resulting in lost fuel efficiency, and the clattering noise that is made as these caps open and shut while the engine idles. An improved cap, such as seen in E. Janke (U.S. Pat. No. 4,495,859), is quieter but still provides a high back pressure during operation.

A weather cap which slides within the exhaust stack under the influence of exhaust pressure is seen in R. Hopkins (U.S. Pat. No. 3,446,010). A pivotal type cap opened by exhaust temperature heating a bimetal strip is seen in R. Jasensky (U.S. Pat. No. 4,205,706). Exhaust pressure is used to move a vane located in the exhaust stack to release a latch and allow the exhaust to open the weather cap in W. Janke (U.S. Pat. No. 3,964,376). The Janke cap cannot be opened from the outside and only opens upon exhaust pressure being applied thereto.

It has been found that the ideal configuration for the outlet of an exhaust stack is one wherein the end of the pipe or stack is cut at a 45° angle from front to back to define an oval rather than circular outlet opening. This angle provides a minimum back pressure to the engine, resulting in improved fuel efficiency. A rain or weather cap cannot be mounted on such an exhaust pipe under any prior art known.

None of the prior art patents show a weather cap in combination with the ideal exhaust stack outlet design for minimizing back pressure. None of the prior art disclose an aerodynamically operated weather cap.

OBJECTS AND SUMMARY OF THE INVENTION

It is the principal object of the present invention to provide a weather or rain cap that assumes an aerodynamic configuration minimizing back pressure in an exhaust stack when a vehicle to which the stack is connected is moving.

It is a related object of the present invention to provide a rain cap that moves from a standby position to an operating position under the influence of air flow created by movement of the vehicle.

It is another object of the present invention to provide a rain cap that connects directly to an exhaust stack of an internal combustion engine.

It is still another object of the present invention to provide a rain cap which minimizes the noise associated with such a cap when the engine is idling and the vehicle is not moving.

In accordance with the objects of the invention, a rain cap is pivotally connected directly to an upstanding exhaust pipe or stack of an internal combustion engine for movement between a standby position, wherein an outlet opening in the exhaust stack is substantially covered, and an operating position, wherein the exhaust stack outlet is open. As the vehicle to which the rain cap is attached moves, the air flow pivots the rain cap about a pivotal axis passing through the exhaust stack and uncovering the exhaust stack outlet as burnt gases escape therefrom. The rain cap is provided with aerodynamic surfaces for interacting with the air flow to cause the pivotal movement.

Once in the operating position, the rain cap presents an aerodynamic fairing to the air flow. The rain cap, in the operating position, is angled from front to back to present an optimum aerodynamic form for decreasing the back pressure to the engine. The aerodynamic surfaces interact with the air flow to hold the rain cap in the operating position.

DESCRIPTION OF THE PREFERRED EMBODIMENT

Figure 1:
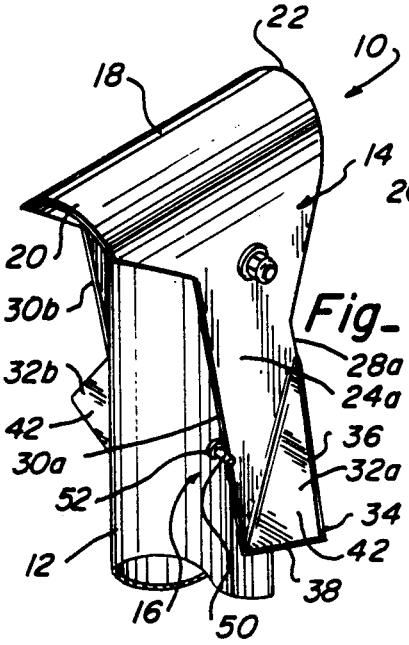
FIG. 1 is a perspective view of a rain cap of the present invention mounted to an exhaust stack, the rain cap being shown in a standby position.

A protective cover device or rain cap 10 is shown in the drawing figures for mounting at the outlet opening of an upstanding exhaust pipe or stack 12 of an internal combustion engine (not shown). When the internal combustion engine is idling or off, the rain cap 10 assumes the standby position shown in FIG. 1 wherein the outlet of the exhaust stack 12 is substantially covered by the rain cap, preventing moisture from entering the outlet of the stack. When the engine is running, and the vehicle associated with the stack 12 is moving, the rain cap 10 moves about pivotal connection 14 to the operating position shown in FIG. 2.

The rain cap 10 is mounted directly to the exhaust stack 12 at the pivotal connection 14, the pivotal axis passing directly through the stack 12. A stop 16 is secured directly to the stack 12 to hold the rain cap in the standby position.

Figure 2:
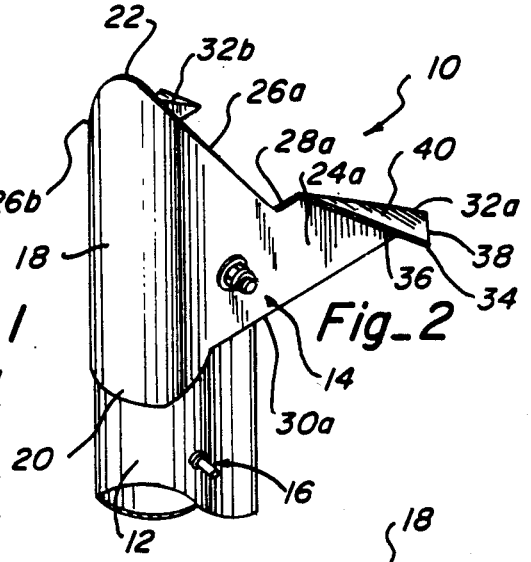
FIG. 2 is a perspective view of the rain cap similar to FIG. 1 with the rain cap shown in an operating position.
Figure 3:
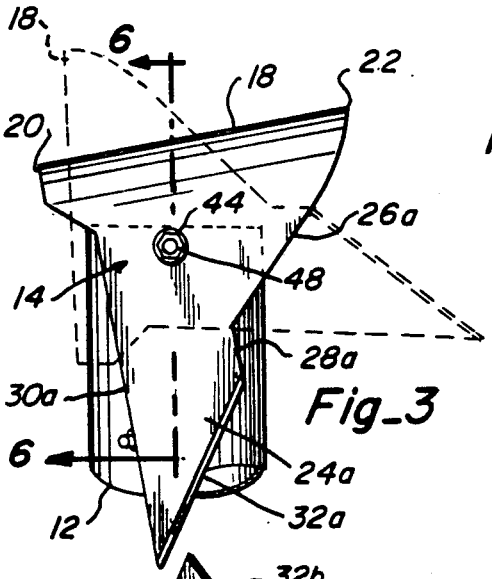
FIG. 3 is a side elevational view of the rain cap shown in FIG. 1, the rain cap shown in an operating position in phantom line.

The rain cap 10 is ideally made of a single piece of sheet metal cut to a predetermined shape and then bent into the shape shown in the drawing figures. A fairing portion 18 of the integral rain cap 10 is seen in FIG. 2 to conform to an outer circumference of the exhaust stack 12 when the rain cap is in the operating position. A lower end 22 of the fairing depends slightly below a pair of rearwardly projecting connecting arms 24*a* and 24*b* of the rain cap. The arms 24*a* and 24*b* bracket the stack 12 and extend rearwardly thereof. An upper end 22 of the fairing 18 projects above the outlet opening of the exhaust stack 12 a predetermined distance, when the rain cap is in the operating position of FIG. 2. A contoured edge includes downwardly and rearwardly angled edges 26*a* and 26*b* sloping away from the upper end 22. The edges 26*a* and 26*b* define a 45° angle with vertical when the rain cap 10 is in the operating position. (FIG. 3). When the rain cap 10 is in the operating position, what has previously been found to be the ideal construction for the outlet of an exhaust stack 12 is presented to the air flow, the 45° angle defined by edges 26*a* and 26*b*. Back pressure at the outlet of the exhaust stack 12 is optimized by this configuration, utilized in exhaust stacks which do not incorporate rain caps.

The connecting arms 24*a* and 24*b* of the rain cap 10 have holes or openings drilled or otherwise formed therethrough for the pivotal connection 14. The arms have upper edges 28*a* and 28*b*, which intersect with the angled edges 26*a* and 26*b*, respectively, and lower edges 30*a* and 30*b* extending a predetermined distance rearwardly of the fairing 18 and the pivotal connection 14. The predetermined distance creates a lever arm or moment about the pivotal connection 14. It is necessary, in order that the rain cap 10 operate properly to cover the outlet, that when the stack 12 is not moving, and no air flow is encountered, the rain cap 10 be automatically positioned in the standby position seen in FIG. 1. Accordingly, the moment created by the arms 24*a* and 24*b* and integrally formed canards or winglets 32*a* and 32*b* must offset the weight of the fairing 18 to pivot the rain cap 10 to the standby position.

The winglets 32*a* and 32*b* are aerodynamic surfaces which project outwardly away from the arms 24*a* and 24*b* to intersect the air flow stream through which the exhaust stack 12 is moving. Air pressure on the winglets forces the winglets to pivot about the pivotal connection 14 to move the rain cap to the operating position. Each of the winglets 32*a* and 32*b*, when the operating position is reached, define a positive angle of attack with respect to the air flow, producing an upward force acting on each winglet 32 and keeping the rain cap 10 in the operating position seen in FIG. 2.

Figure 4:
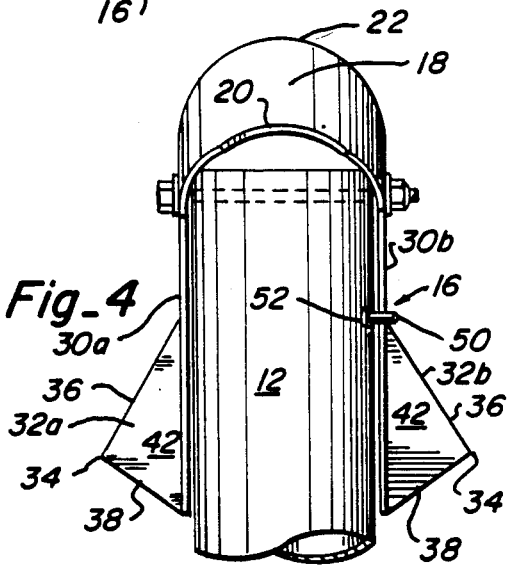
FIG. 4 is a front elevational view of the rain cap shown in FIG. 1.

As seen in FIG. 4, each of the winglets 32*a* and 32*b* are of generally triangular plan view. Each winglet extends outwardly from the upper edges 28*a* and 28*b* to terminate in a tip 34. The sides of the triangular plan view define a leading edge 36 and a trailing edge 38. When the rain cap 10 is moving through the air flow stream, an upper surface 40 thereof defines a region of lower pressure while a lower surface 42 defines a region of relatively higher pressure. The pressure difference acting on the winglet surfaces 40 and 42 results in the force that rotates the rain cap 10 to the operating position and keeps it there.

Figure 6:
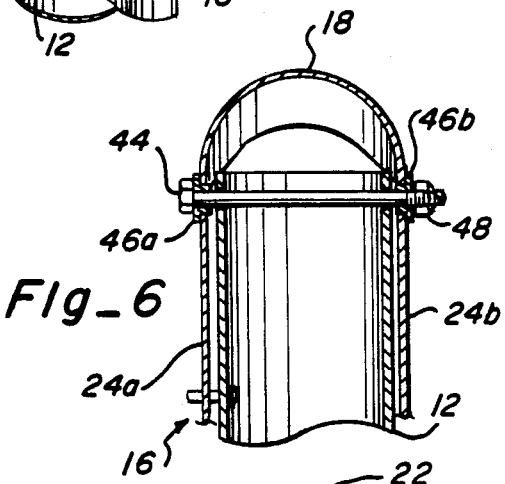
FIG. 6 is a sectional view of the rain cap shown in FIG. 1.
Figure 5:
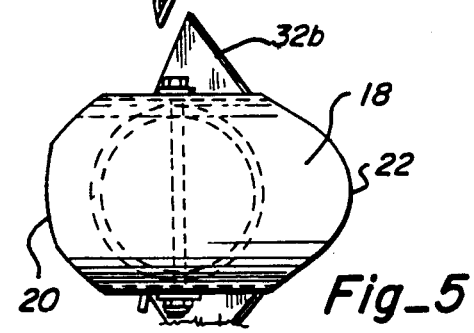
FIG. 5 is a fragmentary top plan view of the rain cap shown in FIG. 1.

The pivotal connection 14 is best seen in FIG. 6. A bolt 44 extends through the rain cap 10 at the predetermined position previously defined so that when the stack 18 is not moving, the rain cap 10 assumes the standby position of FIG. 1. Holes in the stack 12 receive the bolt 44, which bolt 44 is coexistent with a diameter of the stack perpendicular to the air flow stream. Bushings 46*a* and 46*b* in the cap 10 support the bolt 44 and the shank of the bolt rests on and pivots within the holes formed in the stack 12. A lock nut 48 is secured at an end of the bolt, securing the rain cap 10 to the stack 12.

The stop 16 is constructed of a second bolt 50 secured in a preselected position on the stack by a nut 52. The preselected position is the standby position where the rain cap rests.

In operation, the rain cap 10 will typically be in the standby position seen in FIG. 1 during idling of the engine and when the vehicle with which the stack 12 is associated is stopped without the engine running. In the standby position, the outlet of the exhaust stack 12 is substantially covered from the elements. The lower end 20 and upper end 22 of the fairing 18 project forwardly and rearwardly of the outlet respectively to cover secure the outlet from unwanted moisture. When the engine is idling, the exhaust pressure against the upper end 22 of the fairing 18 is not sufficient to overcome the moment arm created by the connecting arms 24*a* and 24*b* and winglets 32*a* and 32*b*, primarily because the exhaust is directed by the fairing 18 in two directions, forwardly and rearwardly of the exhaust stack 12. Substantially equal pressures are therefore exerted against the rain cap fairing 18 at either side of the pivotal connection 14. The rain cap is not constantly opening and closing onto the outlet and the clattering sound of conventional rain caps is avoided.

As the vehicle associated with the stack 12 moves, an air flow stream meets the rain cap 10, and pivots the rain cap to the operating position of FIG. 2. The air flow stream impinges upon the lower surface 42 of the winglets 32*a* and 32*b*, creating a relatively higher pressure than that existing on the upper surface 40 of the winglets. The pressure differential results in a net force rearwardly and then upwardly about the pivotal connection 14. Rotation is stopped as the fairing 18 lower end 20 touches and conforms to the stack 12. The angle of attack maintained by the winglet establishes a positive net force holding the rain cap in the operating position so long as the air flow stream maintains a sufficient air pressure against the winglets.

In the operating position, the upper end 22 of the fairing 18, along with the angled edges 26*a* and 26*b*, define a new contour for the outlet of the stack 12. This contour establishes a zone behind the fairing 18 of relatively lower pressure than that which would otherwise be present were the outlet level or horizontal. This area of relatively lower pressure decreases the pressure which the engine exhaust must overcome, and thereby lowers fuel consumption.

Although the invention has been described with a certain degree of particularity, the scope of the invention is found by reference to the claims as appended hereto and to their equivalents.

What is claimed:

1. A rain cap pivotally connected to an exhaust stack of an internal combustion engine of a moving vehicle comprising in combination:

a fairing substantially covering an outlet of said stack in a standby position and conformable about said stack and uncovering said outlet in an operating position, said fairing pivotally connected for movement about an axis transverse to said stack and substantially perpendicular to the direction of movement of said vehicle, two arms bracketing said stack are integrally connected to said fairing and extend through said pivotal connection a predetermined distance, establishing a lever arm operable on aerodynamic forces to pivot said rain cap from said standby position to said operating position, said arms connected to at least one winglet extending laterally away from the arm to which the winglet is connected, said winglet having a predetermined angle of attack which is presented to air flow created by movement of the vehicle associated with the stack, the aerodynamic force created by the interaction of the winglet and the air flow moving said winglet about the pivotal connection and holding the rain cap in the operating position.

2. The invention as defined in claim 1 wherein said pivotal connection is coexistant with a diameter of said stack.

3. The invention as defined in claim 1 wherein said fairing has an upper end projecting above said outlet, said upper end connected to the arms by downwardly and rearwardly angled edges, said fairing creating an area of lower air flow pressure adjacent said outlet.

4. The invention as defined in claim 3 wherein the angled edges make a 45° angle with a vertical.

5. A protective cover device pivotally connected to an upstanding exhaust stack of a moving vehicle having an internal combustion engine, said pivotal connection about an axis transverse to said stack and substantially perpendicular to the direction of movement of said moving vehicle, said cover comprising a fairing substantially covering an outlet of said stack and integrally connected to a pair of arms spaced apart from each other and bracketing said stack therebetween, said fairing pivotal about said axis between a standby position covering the outlet of said stack and an operating position wherein said fairing substantially conforms about said stack and projects above the outlet of said stack a predetermined distance, said fairing angling away from the direction of movement of said moving vehicle to integrally connect to a pair of arms spaced apart from each other and bracketing said exhaust pipe therebetween, said arms having at a terminal end thereof laterally projecting winglets defining a positive angle of attack relative to the airstream produced by the moving vehicle.

* * * * *